US005924642A

United States Patent [19]

Krebs et al.

[11] Patent Number: 5,924,642

[45] Date of Patent: Jul. 20, 1999

[54] CLEAT HAVING RETRACTABLE RETAINING ARMS

[75] Inventors: Alan Joseph Krebs, Stanwood; John J. Alberts, III, Cadillac, both of Mich.

[73] Assignee: Rexair, Inc., Troy, Mich.

[21] Appl. No.: 09/020,714

[22] Filed: Feb. 9, 1998

[51] Int. Cl.[6] ..... B65H 75/44

[52] U.S. Cl. ..... 242/400.1; 242/575.2; 242/577.4; 191/12 R

[58] Field of Search ..... 242/400.1, 407.1, 242/571, 575.2, 596.1, 577.3, 577.4; 191/42 R, 12.2 R

[56] References Cited

U.S. PATENT DOCUMENTS

| | | | |
|---|---|---|---|
| 1,728,106 | 9/1929 | Collins . | |
| 2,110,036 | 3/1938 | Chirelstein . | |
| 2,156,467 | 5/1939 | Walter . | |
| 2,184,363 | 12/1939 | Schultz . | |
| 2,280,012 | 4/1942 | Stasio . | |
| 2,693,001 | 11/1954 | Vance . | |
| 4,893,037 | 1/1990 | Schwartz | 9/25 |
| 4,910,444 | 3/1990 | Kilström et al. | 3/12 |
| 4,948,065 | 8/1990 | Zelmin | 75/48 |

FOREIGN PATENT DOCUMENTS

| | | | |
|---|---|---|---|
| 593152 | 2/1960 | Canada | 242/400.1 |
| 852216 | 10/1952 | Germany | 242/571 |
| 261553 | 12/1928 | Italy | 242/575.2 |
| 112117 | 10/1944 | Sweden | 242/400.1 |
| 466226 | 5/1937 | United Kingdom | 242/400.1 |

*Primary Examiner*—Donald P. Walsh
*Assistant Examiner*—William A. Rivera
*Attorney, Agent, or Firm*—Howard & Howard

[57] ABSTRACT

A cleat for attachment to a device having a power cord. The cleat includes a center support attached to the device for selectively retaining the power cord adjacent to the device. A pair of cord retaining arms extend from the center support in opposite directions. The pair of cord retaining arms are supported by the center support for rectilinear movement between an extended position forming a cord wrapping pocket between each of the arms and the device for retaining the power cord about the center support and in the pockets and a retracted position closing the arms for releasing the power cord from the center support. In a preferred embodiment, the cleat further includes an intercoupling mechanism interconnecting the pair of arms for synchronous movement of one of the arms in response to the rectilinear movement of the other arm. The synchronous movement is movement in a direction opposite and through the same distance as the other arm. The intercoupling mechanism includes a first rack attached to one of the arms, a second rack attached to the other arm, and a ring gear meshed between the first rack and the second rack.

6 Claims, 4 Drawing Sheets

CLEAT HAVING RETRACTABLE RETAINING ARMS

BACKGROUND OF THE INVENTION

1. Field of the Invention

This invention relates to a cleat having retractable retaining arms.

2. Description of the Prior Art

Many electrical devices, such as vacuum cleaners, include a power cord which is intended to be plugged into an electrical outlet only when the device is being used. Typically, these electrical devices further include a cleat or cord winder to manage the power cord when the device is stored.

Prior art cleats include a center support about which the power cord may be wrapped and two fixed arms projecting in opposite directions from the center support for retaining the power cord on the center support. Prior to using the electrical device, the power cord must be unwrapped from the center support around the retaining arms. Although cleats are simple and inexpensive, they are often unsightly, shoddy, and prone to break.

Prior art cord winders typically include a spring-driven mechanism automatically winding the power cord with the press of a button. Although cord winders provide a quick and concealed manner in which to manage the power cord, they are more expensive than cleats. Accordingly, there is a need for a cleat which overcomes the shortcomings of the prior art.

SUMMARY OF THE INVENTION AND ADVANTAGES

The present invention provides a cleat for attachment to a device having a power cord. The cleat includes a center support attached to the device for selectively retaining the power cord adjacent to the device. A pair of cord retaining arms extend from the center support in opposite directions. The pair of cord retaining arms are supported by the center support for rectilinear movement between an extended position forming a cord wrapping pocket between each of the arms and the device for retaining the power cord about the center support and in the pockets and a retracted position closing the arms for releasing the power cord from the center support.

With the retaining arms in the retracted position, the power cord may be quickly slid off the center support thereby eliminating the time and labor necessary to unwrap the cord. Further, in the retracted position, the retaining arms aesthetically conceal the cleat and are protected from breakage.

In a preferred embodiment, the cleat further includes an intercoupling mechanism interconnecting the pair of arms for synchronous movement of one of the arms in response to the rectilinear movement of the other arm. The synchronous movement is movement in a direction opposite and through the same distance as the other arm. The intercoupling mechanism includes a first rack attached to one of the arms, a second rack attached to the other arm, and a ring gear meshed between the first rack and the second rack.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
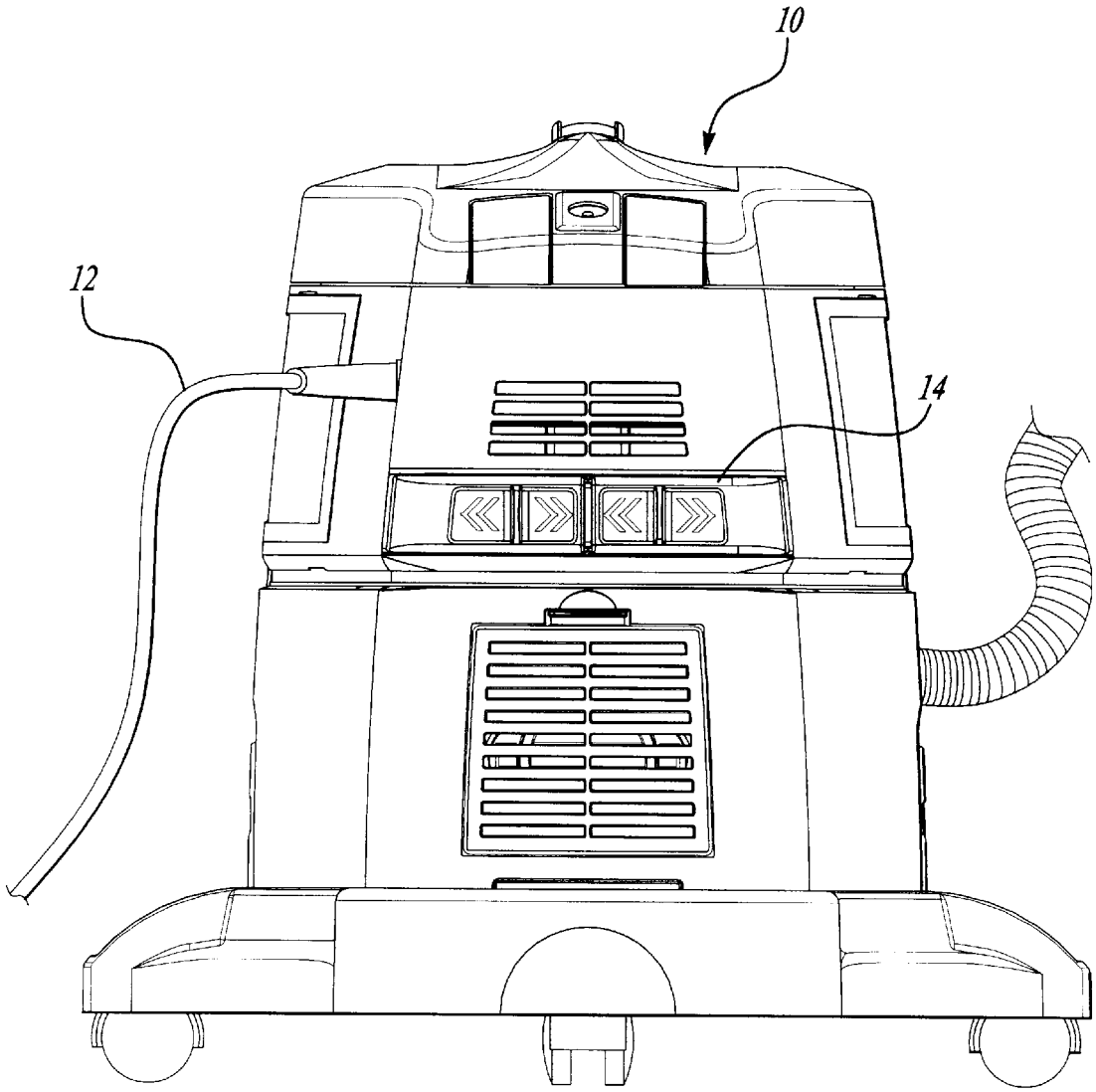
FIG. 1 is a perspective side view of a vacuum cleaner having a power cord and incorporating a cleat in accordance with the present invention.

Referring to the Figures, wherein like numerals indicate like or corresponding parts throughout the several views, an electrical device 10 having a power cord 12 and incorporating a cleat 14 in accordance with the present invention is shown. The electrical device 10 may be, for example, a vacuum cleaner as shown in FIG. 1.

Figure 2:
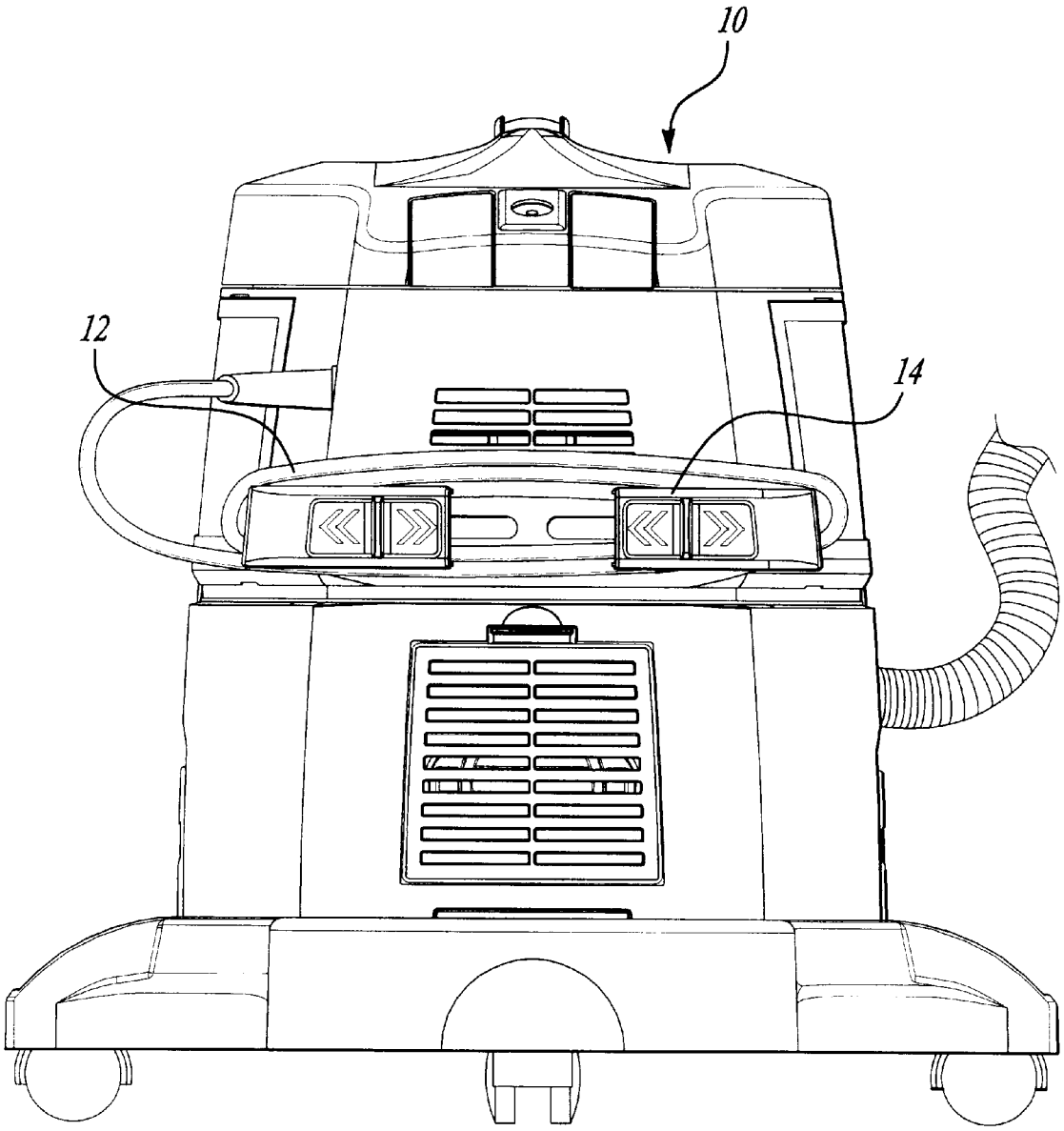
FIG. 2 is a perspective side view of the vacuum cleaner with the power cord wrapped about the cleat.

FIG. 2 is a perspective side view of the electrical device 10 with the power cord 12 wrapped about the cleat 14. While the present invention has been combined with an electrical device having a power cord for example purposes, one skilled in the art will recognize that the inventive cleat may be used to manage any type of cord, line, rope, or similar structure.

Figure 3:
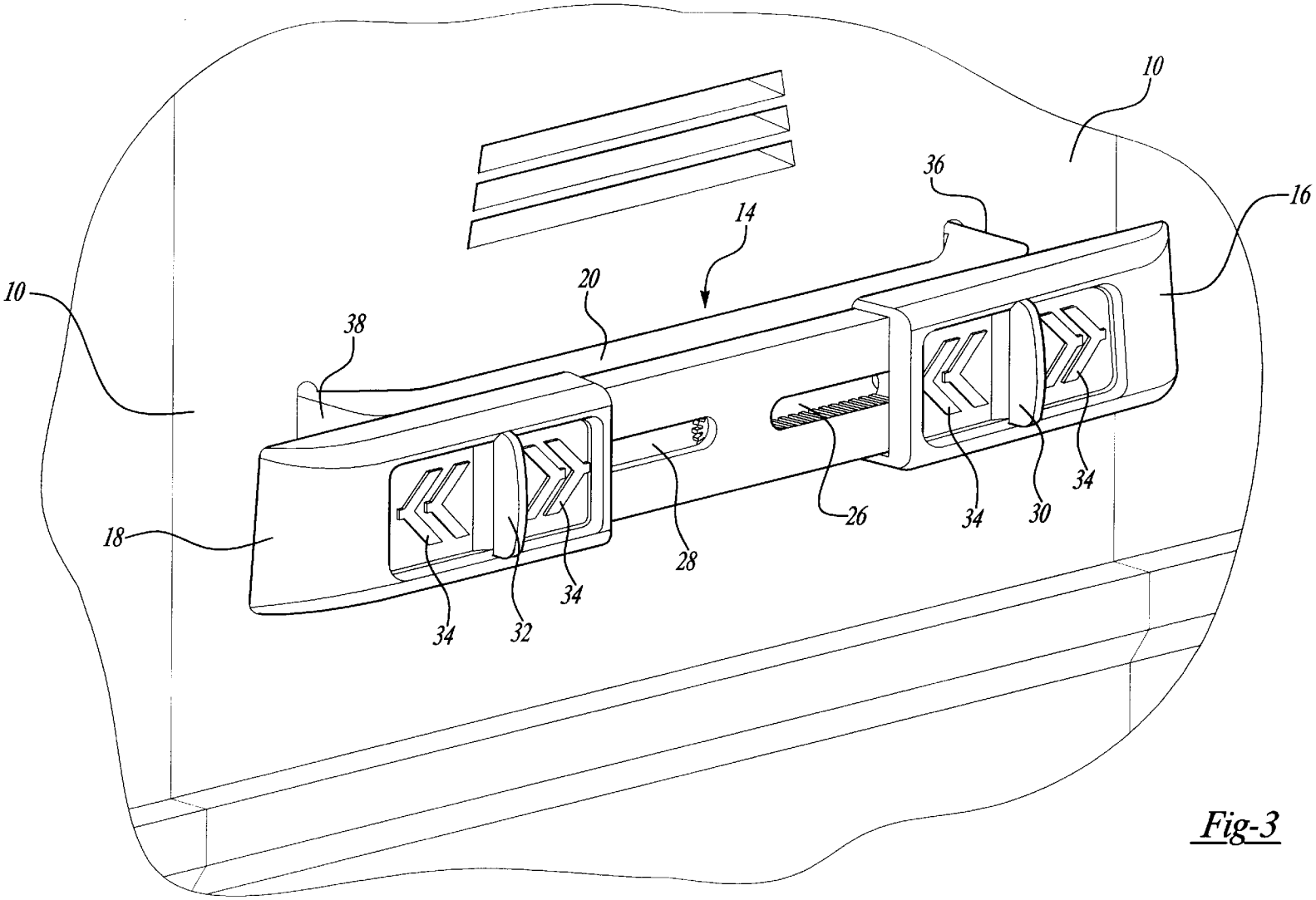
FIG. 3 is a fragmentary perspective side view of the vacuum cleaner with the cleat having a pair of retaining arms shown in an extended position.

FIG. 3 is a fragmentary perspective side view of the electrical device 10 showing the cleat 14. The cleat 14 includes a first retaining arm 16, a second retaining arm 18, and a center support 20. The center support 20 includes a pair of slots 26 and 28. The first and second retaining arms 16 and 18 are slidably mounted within the slots 26 and 28 respectively. The slots 26 and 28 guide the retaining arms 16 and 18 in a rectilinear direction as the retaining arms 16 and 18 are manually moved. Both the first retaining arm 16 and the second retaining arm 18 include a handle 30 and 32 respectively for manually moving the arms 16 and 18. Both the first retaining arm 16 and the second retaining arm 18 further include indicia 34 indicating the directions in which each arm 16 and 18 may be moved.

In FIG. 3, the retaining arms 16 and 18 are shown in an extended position wherein the retaining arms 16 and 18 extend in opposite directions beyond the center support 20. In the extended position, the first retaining arm 16, the center support 20, and the electrical device 10 form a first pocket 36 adjacent to one end of the center support 20 and the second retaining arm 18, the center support 20, and the electrical device 10 form a second pocket 38 adjacent to the opposite end of the center support 20. The power cord (not shown) may be wrapped about the center support 20 in the pockets 36 and 38. In the extended position, the retaining arms 16 and 18 retain the power cord about the center support 20 and in the pockets 36 and 38.

Figure 4:
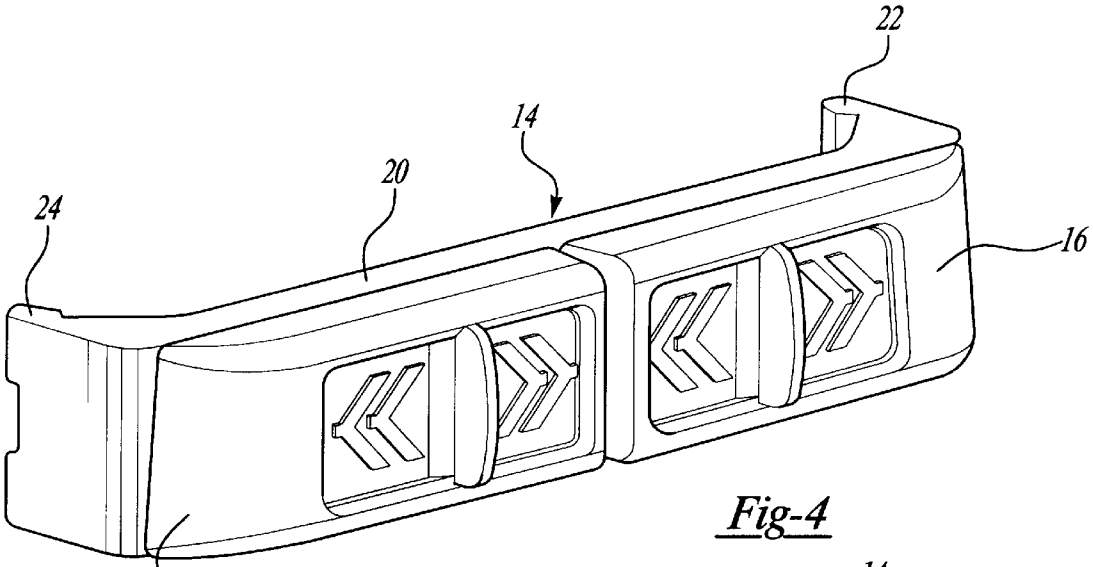
FIG. 4 is a perspective front view of the cleat with the pair of retaining arms shown in a retracted position.

FIG. 4 is a perspective front view of the cleat 14 with the pair of retaining arms 16 and 18 shown in a retracted position. In the retracted position, the retaining arms 16 and 18 are closed and the power cord (not shown) may be slid off the center support 20. This eliminates the time and labor necessary to unwrap the power cord from the cleat 14. However, one skilled in the art will appreciate that should a user desire to use only a portion of the length of the power cord, the retaining arms may be left in the extended position and the appropriate length of power cord may be unwrapped from the cleat 14. In the retracted position, the retaining arms 16 and 18 aesthetically conceal the cleat 14 and are protected from breakage. FIG. 4 further shows the center support 20 includes a pair of feet 22 and 24 used to attach the cleat 14 to the electrical device (not shown).

Figure 5:
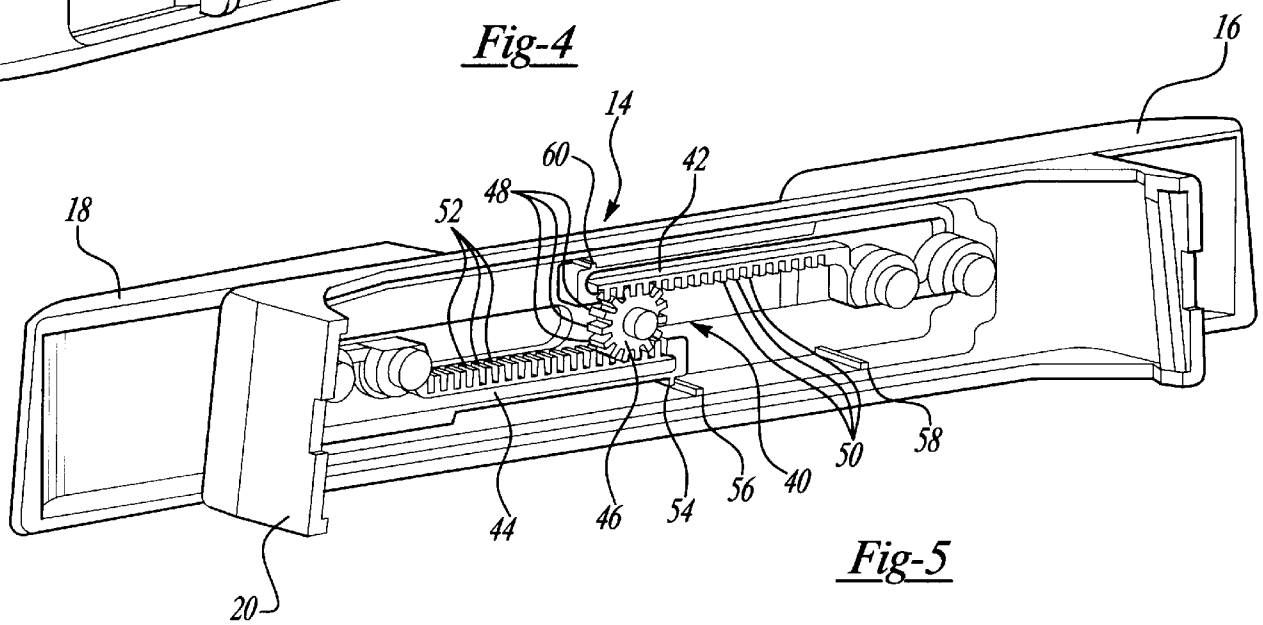
FIG. 5 is a perspective rear view of the cleat showing an intercoupling mechanism attached to the pair of retaining arms.

FIG. 5 is a perspective rear view of the cleat 14 showing an intercoupling mechanism 40 attached to the pair of retaining arms 16 and 18. The intercoupling mechanism 40 includes a first rack 42 attached the first retaining arm 16, a second rack 44 attached the second retaining arm 18, and a ring gear 46 meshed between the first rack 42 and the second rack 44. The ring gear 46 is rotatably mounted to the center support 20 and includes a set of teeth 48. Both the first rack 42 and the second rack 44 include a set of teeth 50 and 52 respectively which are adapted to mesh with the teeth 48 of the ring gear 46. The intercoupling mechanism 40 interconnects the first retaining arm 16 and the second retaining arm 18 such that the movement of either arm synchronously moves the other arm in an opposite rectilinear direction and through the same distance.

In FIG. 5, retaining arms 16 and 18 are shown in the extended position. As the first retaining arm 16 is manually moved to the retracted position, the ring gear 46 is driven by the first rack 42 in a counter-clockwise direction thereby causing the second retaining arm 18 to synchronously move in a direction opposite of the first retaining arm 16. Similarly, as the second retaining arm 18 is manually moved to the retracted position, the ring gear 46 is driven by the second rack 44 in a counter-clockwise direction thereby causing the first retaining arm 16 to synchronously move in a direction opposite of the second retaining arm 18.

Alternately, as the first retaining arm 16 is manually moved from the retracted position to the extended position, the ring gear 46 is driven by the first rack 42 in a clockwise direction thereby causing the second retaining arm 18 to synchronously move in a direction opposite of the first retaining arm 16. Finally, as the second retaining arm 18 is manually moved from the retracted position to the extended position, the ring gear 46 is driven by the second rack 44 in a clockwise direction thereby causing the first retaining arm 16 to synchronously move in a direction opposite of the second retaining arm 18.

As shown in FIG. 5, the second rack 44 further includes a first locking foot 54 which interacts with a first positioning tab 56 and a second positioning tab 58 located on the center support 20 to restrain the second retaining arm 18 in the extended and retracted positions. When the second retaining arm 18 is located in the extended position, the first positioning tab 56 provides a degree of resistance to movement of the second arm 18 towards the retracted position. Conversely, when the second retaining arm 18 is located in the retracted position, the second positioning tab 58 provides a degree of resistance to movement of the second arm 18 towards the extended position. However, each degree of resistance can be overcome with an application of deliberate pressure on the handle 32 of the second retaining arm 18 in the appropriate direction. Accordingly, the first rack 42 further includes a second locking foot 60 which interacts with a third and fourth positioning tab (not shown) to restrain the first retaining arm 16 in the extended and retracted positions in a like manner.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An electrical device having a cleat for selectively retaining an electrical power cord to said device, said cleat comprising:

a center support having first and second end attached to said device for supporting said power cord adjacent to said device; and a pair of cord retaining arms moveably supported by said center support, wherein each of said arms is moveable along a rectilinear path between a retracted position with said arms positioned completely between said first and second ends for releasing said power cord from said center support to an extended position with said arms extending outside of said first and second ends forming a cord wrapping pocket between each of said arms and said device for receiving and retaining said power cord within said pockets and supported by said center support.

2. An electrical device as set forth in claim 1 wherein said cleat further includes an intercoupling mechanism interconnecting said pair of arms for providing synchronous movement of said arms between said retracted and extended positions.

3. An electrical device as set forth in claim 2 wherein said synchronous movement of one of said arms is defined by movement in a direction opposite and through the same rectilinear distance as said other of said arms.

4. An electrical device as set forth in claim 3 wherein said intercoupling mechanism includes a first rack attached to one of said arms, a second rack attached to said other arm, and a ring gear meshed between said first rack and said second rack.

5. An electrical device as set forth in claim 4 wherein said center support includes a pair of slots for receiving said respective pair of cord retaining arms, said pair of slots providing said rectilinear movement of said arms with respect to said center support between said retracted and extended positions.

6. An electrical device as set forth in claim 5 wherein each of said cord retaining arm including a handle for manually and simultaneously moving both of said arms between said retracted and extended positions.

* * * * *